US007367873B2

(12) United States Patent
Ishii et al.

(10) Patent No.: US 7,367,873 B2
(45) Date of Patent: May 6, 2008

(54) SUBSTRATE PROCESSING APPARATUS

(75) Inventors: You Ishii, Tokyo (JP); Masayuki Nakanishi, Tokyo (JP); Kenro Nakamura, Kamakura (JP)

(73) Assignees: Ebara Corporation, Tokyo (JP); Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/364,359

(22) Filed: Feb. 12, 2003

(65) Prior Publication Data

US 2004/0106363 A1 Jun. 3, 2004

(30) Foreign Application Priority Data

Feb. 12, 2002 (JP) ..... 2002-034129

(51) Int. Cl.
*B24B 5/00* (2006.01)
*B24B 9/00* (2006.01)
*B24B 49/00* (2006.01)

(52) U.S. Cl. ..... 451/168; 451/65; 451/6; 451/173; 451/444

(58) Field of Classification Search ..... 451/296, 451/43, 44, 303, 307, 65, 63, 41, 164, 168, 451/173, 313, 443, 444, 317, 6, 295
See application file for complete search history.

(56) References Cited

U.S. PATENT DOCUMENTS 4,031,668 A * 6/1977 Lasko et al. ..... 451/303
4,514,937 A * 5/1985 Gehrung et al. ..... 451/307
5,128,281 A * 7/1992 Dyer et al. ..... 451/63
5,209,027 A * 5/1993 Ishida et al. ..... 451/303
5,289,661 A * 3/1994 Jones et al. ..... 451/44
5,431,592 A * 7/1995 Nakata ..... 451/63
5,514,025 A * 5/1996 Hasegawa et al. ..... 451/44
5,980,368 A * 11/1999 Chang et al. ..... 451/303
6,132,289 A * 10/2000 Labunsky et al. ..... 451/6
6,306,014 B1 * 10/2001 Walker et al. ..... 451/296
6,402,596 B1 * 6/2002 Hakomori et al. ..... 451/44
6,439,967 B2 * 8/2002 Carpenter ..... 451/41
6,475,293 B1 * 11/2002 Moinpour et al. ..... 451/44
2002/0142707 A1 * 10/2002 Shimada et al. ..... 451/44
2003/0139049 A1 7/2003 Nakamura et al.
2004/0185751 A1 9/2004 Nakanishi et al.
2005/0250423 A1 * 11/2005 Nakamura et al. ..... 451/41

FOREIGN PATENT DOCUMENTS

JP 5-329759 12/1993

* cited by examiner

*Primary Examiner*—Hadi Shakeri
(74) *Attorney, Agent, or Firm*—Wenderoth, Lind & Ponack, L.L.P.

(57) ABSTRACT

A substrate processing apparatus has a polishing tape and a polishing head for pressing the polishing tape against a peripheral portion of a semiconductor wafer. The substrate processing apparatus polishes the wafer due to sliding contact of the polishing tape and the wafer. The polishing head has an elastic body for supporting the polishing tape. The substrate processing apparatus has an air cylinder for pressing the polishing head so that the elastic body of the polishing head presses the polishing tape against the predetermined portion of the wafer under a constant force.

9 Claims, 13 Drawing Sheets

SUBSTRATE PROCESSING APPARATUS

BACKGROUND OF THE INVENTION

1. Field of the Invention

The present invention relates to a substrate processing apparatus, and more particularly to a substrate processing apparatus for removing surface roughness produced at a peripheral portion (a bevel portion and an edge portion) or the like of a substrate such as a semiconductor wafer, or for removing a film attached to a peripheral portion or the like of a substrate which would cause contamination.

2. Description of the Related Art

In recent years, according to finer structures of semiconductor elements and higher integration of semiconductor devices, it has become more important to manage particles. One of the major problems in managing particles is dust caused by surface roughness produced at a bevel portion and an edge portion of a semiconductor wafer (substrate) in a manufacturing process of semiconductor devices. In this case, a bevel portion means a portion having a curvature in a cross-section of an edge of a semiconductor wafer. Further, an edge portion means a flat portion extending about several millimeters radially inwardly from a bevel portion of a wafer.

For example, the aforementioned surface roughness caused by processing is produced in a RIE (Reactive Ion Etching) process of forming trenches (deep trenches) for a trench capacitor on a surface of a Si wafer. In a RIE process, as shown in FIG. 1A, a hard mask comprising laminated films composed of a SiN film 500 and a $SiO_2$ film 510 is first formed on a Si wafer 100, and then the Si wafer 100 is etched by an RIE method while the hard mask serves as a mask, thereby forming deep trenches 520 (see FIG. 1B).

In this RIE process, by-products produced during etching may be attached to a bevel portion and an edge portion of the Si wafer 100 and serve as masks for etching, thereby forming needle projections 530 at the bevel portion and the edge portion of the Si wafer 100, as shown in FIG. 1B. Particularly, in a case of forming, with accuracy, deep trenches 520 having an opening diameter of a submicron and an aspect ratio as high as multiples of ten, the aforementioned needle projections 530 are inevitably produced under such process conditions at the bevel portion and the edge portion.

The heights of the needle projections 530 vary depending on the positions of the needle projections 530 and are as large as about 10 μm at their maximum height. The needle projections 530 are broken in transferring or processing the Si wafer 100 and thus cause particles to be produced. Since such particles lead to a lower yield, it is necessary to remove the needle projections 530 formed at the bevel portion and the edge portion.

A CDE (Chemical Dry Etching) method has heretofore been employed in order to remove such needle projections 530. In a CDE method, a resist 540 is first applied on surfaces except for a region of several millimeters which includes the bevel portion and the edge portion of the Si wafer 100, as shown in FIG. 2A. Then, a portion of the Si wafer 100 that is not covered with the resist 540 is isotropically etched to remove the needle projections 530 at the bevel portion and the edge portion (see FIG. 2B). Thereafter, the resist 540, which has protected the device surfaces, is removed (see FIG. 2C).

With such a CDE method, since device surfaces should be protected by a resist 540, it is necessary to apply a resist and remove the resist. Further, although sharp needle portions can be removed by isotropic etching, irregularities 550 are formed depending on the variation of the heights of the needle projections 530 (see FIG. 2C). These types of irregularities 550 may be problematic because dust tends to accumulate in the irregularities 550 during subsequent processes such as CMP (Chemical Mechanical Polishing). However, the conventional CDE method has difficulty in completely removing such surface roughness at the bevel portion and the edge portion of the Si wafer 100. Further, the time required for processing a single wafer in a CDE process is usually 5 minutes or more, and hence a CDE process has problems in that it causes a lower throughput and has high material costs.

Further, new materials, such as Cu as a wiring material, Ru and Pt as a capacitor electrode material for next-generation DRAM and FeRAM, and TaO and PZT as a capacitor dielectric material, have recently been introduced in the fields of semiconductor devices one after another. Now is the time to seriously consider problems of device contamination caused by these new materials in the mass production of semiconductor devices. Particularly, in a manufacturing process of a semiconductor device, since films of new materials which are attached to a bevel portion, an edge, and a reverse face of a wafer may cause contamination, removal of such films represents an important problem.

For example, when a Ru film to be used as a capacitor electrode is deposited, it is important to remove the Ru film attached to a bevel portion, an edge portion, and a reverse face. Currently, a CVD (Chemical Vapor Deposition) method is generally used as a deposition method of such a Ru film. With the CVD method, attachment of a Ru film to a bevel portion, an edge portion, and a reverse face is unavoidable, while degrees of the attachment are different depending on device arrangements. Even if a Ru film is deposited with an edge cut ring by a sputtering method, it is difficult to completely eliminate the attachment of a Ru film to a bevel portion and an edge portion due to wraparounds of sputter particles (Ru). When an edge cut width is reduced in order to increase a yield of peripheral chips, it is more difficult to completely eliminate attachment of a Ru film.

With any deposition method, a Ru film is attached to a bevel portion, edge portion, or a reverse face of a wafer after Ru deposition. As described above, this type of Ru film attached to a bevel portion or the like should be removed because it causes device contamination in the next processes.

Removal of a Ru film attached to a bevel portion or the like has heretofore been performed by a wet-etching method. A wet-etching method generally includes dropping a chemical liquid onto a Si wafer being rotated horizontally while a reverse face of the Si wafer faces upwardly. With respect to a bevel portion and an edge portion, removal of a Ru film is performed by adjusting a rotational speed or the like to adjust the amount of the chemical liquid flowing onto a device-formed surface.

However, with this method, because a removal rate of a Ru film is about 10 nm/min, a period of time for processing a single wafer is usually as long as 5 minutes or more, thereby resulting in a lowered throughput. Further, it is impossible to remove Ru diffused in an underlying layer, and, in order to remove such Ru, it is necessary to perform additional wet-etching with another chemical liquid that can etch the underlying layer, thereby resulting in a further lowered throughput. Furthermore, this method has another problem in that there are no adequate chemical liquids that do not damage a device.

SUMMARY OF THE INVENTION

The present invention has been made in view of the above drawbacks in the prior art, and it is, therefore, an object of the present invention to provide a substrate processing apparatus which can effectively remove surface roughness produced at a peripheral portion of a substrate or the like or a film attached to a peripheral portion of a substrate or the like, which would cause contamination, in a manufacturing process of a semiconductor device or the like.

In order to solve such drawbacks in the prior art, according to a first aspect of the present invention, there is provided a substrate processing apparatus comprising: a polishing tape; a polishing head having an elastic body for supporting the polishing tape; and a pressing mechanism for pressing the polishing head so that the elastic body of the polishing head presses the polishing tape against a predetermined portion of a substrate under a constant force. The substrate processing apparatus polishes the substrate by sliding contact between the polishing tape and the substrate.

By removing needle projections at a bevel portion and an edge portion of a substrate by polishing with the use of a polishing film, it becomes unnecessary to protect a device-formed surface with a resist, which has been essential in the conventional CDE method. As a result, it is possible to omit two processes including applying a resist for protection and removing the resist after removing needle projections, thereby resulting in an improved throughput. Further, since a surface on the bevel portion and the edge portion from which the needle projections have been removed becomes a smooth surface, the aforementioned problems in the CDE method can be solved.

Further, by removing a film attached to a peripheral portion of a substrate or the like, which would cause contamination, by polishing with use of a polishing tape, a removal process can be achieved with a single process. Therefore, a film which would cause contamination can be removed in a shorter time as compared to the conventional wet-etching method, and hence the throughput can be improved.

Here, the polishing tape may be formed by a thin polishing film. Further, a polishing tape made of a material having a high flexibility may be used. Since a thin polishing film is used as a polishing tape, the polishing tape is not folded or bent on a surface of a substrate, particularly at a peripheral portion (a bevel portion and an edge portion). Therefore, the polishing tape can be reliably fitted along a curved shape of the peripheral portion of the substrate, and hence it is possible to uniformly polish the peripheral portion of the substrate. As a result, needle projections formed on a surface of a substrate or an undesired Ru film attached to a surface of a substrate can be removed uniformly and stably by polishing. Here, "a polishing tape" means a polishing tool in the form of a tape, and such a polishing tape includes a polishing film having a base film onto which polishing abrasive particles are applied, and a polishing cloth in the form of a tape.

Thus, the pressing mechanism presses the polishing head so as to keep a pressing force applied to the polishing tape at a predetermined value during polishing. Therefore, even if the elastic body has been elongated due to deterioration, the pressing mechanism presses the polishing head as a result of the elongation of the elastic body. Thus, a tension of the elastic body hardly changes, and hence a polishing rate by the polishing tape can continuously be kept constant irrespective of deterioration of the elastic body to achieve uniform polishing.

According to a preferred aspect of the present invention, the pressing mechanism is arranged so that the pressing force is adjustable during polishing. With this arrangement, a pressing force by the pressing mechanism can be adjusted to vary the pressing force applied to the polishing tape during polishing, thereby achieving a desired polishing profile at a predetermined portion of the substrate.

According to a preferred aspect of the present invention, the substrate processing apparatus further comprises a pressing plate for pressing the elastic body and the polishing tape against an edge portion of the substrate. The pressing plate may be movable in a radial direction of the substrate.

According to a preferred aspect of the present invention, the substrate processing apparatus further comprises a grinding wheel for polishing a notch of the substrate. In this case, the substrate processing apparatus may further comprise a notch sensor for detecting the notch of the substrate.

According to a second aspect of the present invention, there is provided a substrate processing apparatus comprising a polishing tape, and a polishing head for pressing the polishing tape against a predetermined portion of a substrate. The polishing head comprises a deformable fluid bag for supporting the polishing tape, a pressurized fluid being supplied to an interior of the fluid bag, and a support portion for receiving the fluid bag and supporting the fluid bag.

With this arrangement, by supplying a pressurized fluid to the fluid bag, the fluid bag supporting the polishing tape is deformed so that the polishing tape is brought into contact uniformly with the predetermined portion of the substrate. Therefore, it is possible to uniformly polish the predetermined portion of the substrate.

In this case, the polishing tape may be formed by a polishing film. Alternatively, the polishing tape is formed by a polishing cloth, and the substrate is polished while a polishing material or an etching liquid is supplied onto a surface of the substrate. Further, the fluid bag may be formed by the polishing tape.

According to a preferred aspect of the present invention, the substrate processing apparatus further comprises a fluid supply source for supplying a fluid having a desirable pressure to the fluid bag.

DETAILED DESCRIPTION OF THE PREFERRED EMBODIMENTS

Figure 1A:
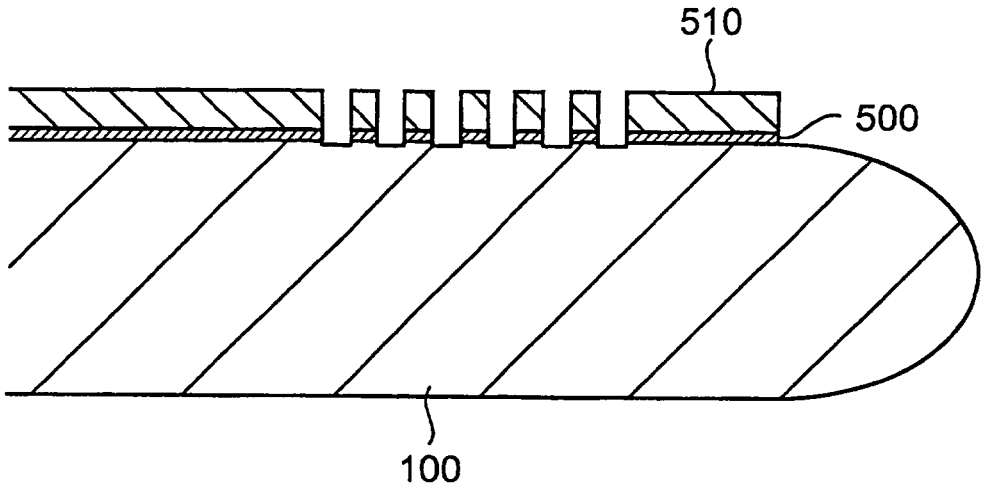
FIG. 1A (PRIOR ART)
FIGS. 1A and 1B are cross-sectional views showing a process of forming deep trenches in a trench capacitor.

Embodiments of a substrate processing apparatus according to the present invention will be described in detail below with reference to the accompanying drawings. A substrate processing apparatus according to the present invention serves to polish surfaces of a substrate such as a semiconductor wafer (Si wafer), and to process a bevel portion, an edge portion, and/or a reverse face of the wafer. The substrate processing apparatus has a polishing unit for polishing surfaces of a semiconductor wafer. Identical or corresponding components are designated by identical reference numerals throughout the drawings and will not be described repetitively.

Figure 3:
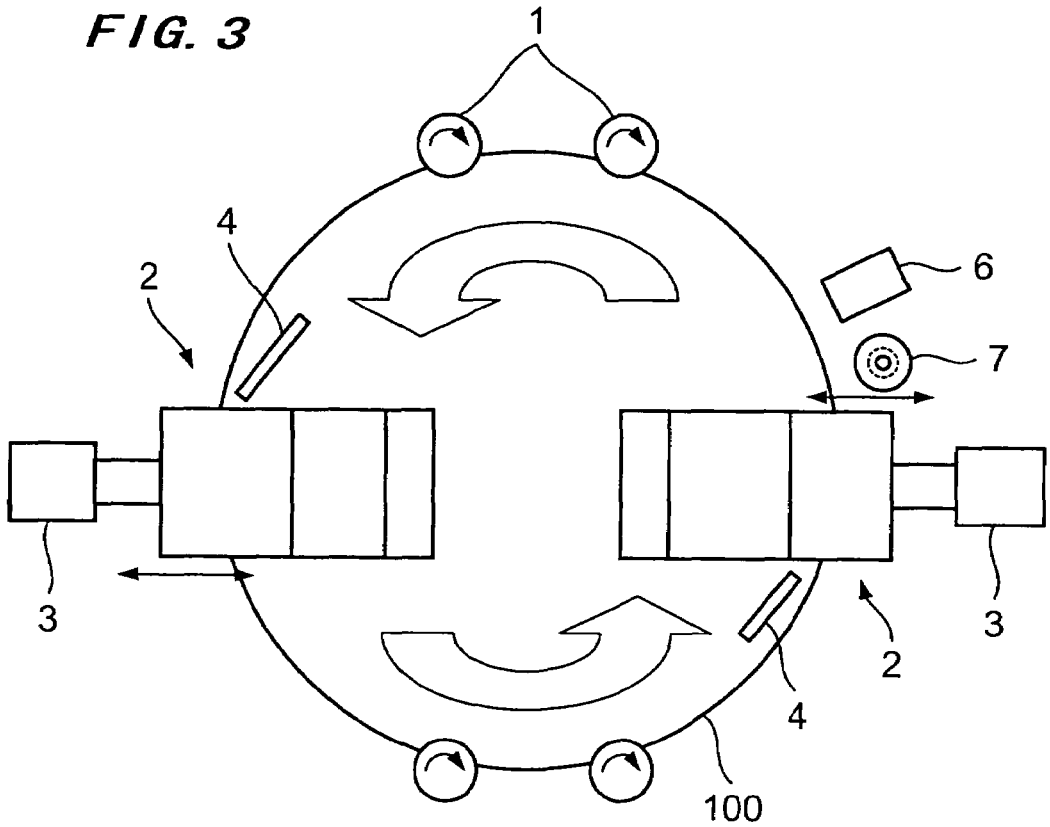
FIG. 3 is a schematic plan view showing a polishing unit according to a first embodiment of the present invention.
Figure 4:
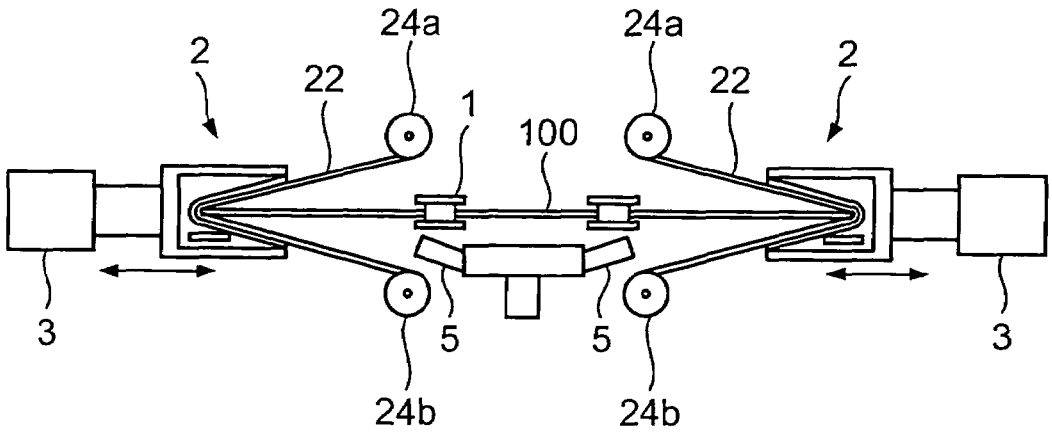
FIG. 4 is a front cross-sectional view of the polishing unit shown in FIG. 3.

First, a polishing unit of a substrate processing apparatus according to a first embodiment of the present invention will be described. FIG. 3 is a schematic plan view showing a polishing unit according to the first embodiment of the present invention, and FIG. 4 is a front cross-sectional view of the polishing unit shown in FIG. 3. As shown in FIGS. 3 and 4, the polishing unit comprises a plurality of rollers 1 for rotatably holding a semiconductor wafer 100, polishing heads 2 for polishing a bevel portion and an edge portion of the wafer 100, air cylinders (pressing mechanism) 3 for pressing the polishing head 2 to the wafer 100, chemical liquid supply nozzles 4 for supplying a chemical liquid (or pure water) to the bevel portion and the edge portion of the wafer 100, a plurality of gas ejection nozzles 5 for ejecting a gas such as air or nitrogen toward a device-formed surface (i.e., a lower surface in FIG. 4) of the wafer 100, a notch sensor 6 for detecting a notch of the wafer 100, and a grinding wheel 7 for polishing the notch of the wafer 100. The semiconductor wafer 100 is set so that the device-formed surface thereof faces downwardly in view of a countermeasure of particles falling from above.

Figure 5:
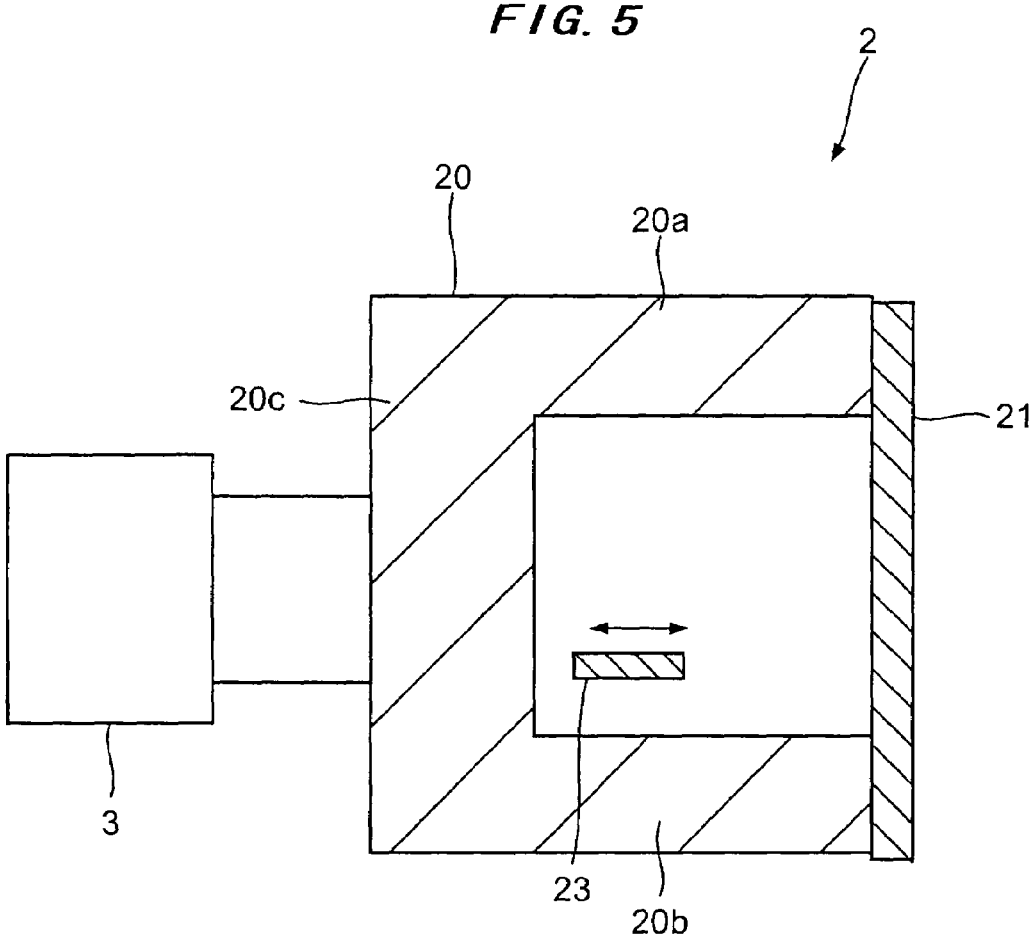
FIG. 5 is a cross-sectional view showing a main part of the polishing head of the polishing unit of FIG. 3.
Figure 6:
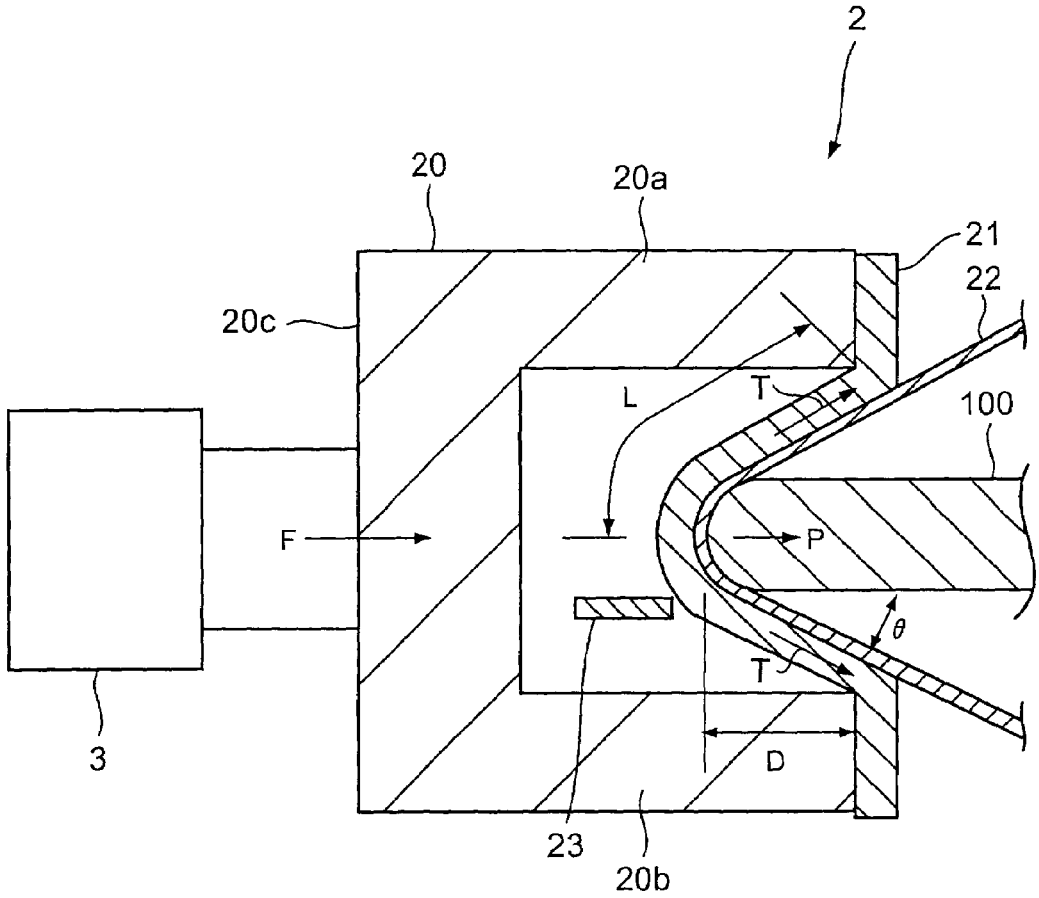
FIG. 6 is a cross-sectional view showing a state of the polishing head shown in FIG. 5 at the time of polishing.

FIG. 5 is a cross-sectional view showing a main part of the polishing head 2 of FIG. 3, and FIG. 6 is a cross-sectional view showing a state of the polishing head shown in FIG. 5 at the time of polishing. As shown in FIGS. 3 through 6, the polishing head 2 comprises a support portion 20 having two projecting portions 20*a*, 20*b*, an elastic member 21, such as elastic rubber, extending between ends of these projecting portions 20*a*, 20*b*, a polishing film 22 as a polishing tape supported by the elastic member 21, and a pressing plate 23 made of an elastic body.

The polishing head 2 can be moved in a radial direction of the semiconductor wafer 100 by a moving mechanism, which is not shown. The air cylinder 3 is connected to a base portion 20*c* of the support portion 20 of the polishing head 2. When the air cylinder 3 is actuated to move the support portion 20 toward a center of the wafer 100, the polishing film 22 is pressed via the elastic member 21 against the bevel portion and the edge portion of the wafer 100. Details of actuation of the air cylinder 3 will be described later. A mechanism for changing a distance between the projecting portions 20*a*, 20*b* may be provided in the polishing head 2.

The polishing film 22 is housed in a polishing cassette, which is not shown, and wound by reels 24*a*, 24*b* (see FIG. 4) in the polishing cassette while a predetermined tension is applied to the polishing film 22. A polishing film 22 that has been worn by polishing the wafer 100 is taken up before a polishing rate is lowered, so that a new polishing film is brought into contact with the wafer 100. The polishing film 22 is pressed under a predetermined pressing-force against the bevel portion and the edge portion of the wafer 100 while the wafer 100 is rotated. Thus, the bevel portion and the edge portion of the wafer 100 and the polishing film 22 are brought into sliding contact with each other to polish the bevel portion and the edge portion of the wafer. The polishing film 22 may be moved with respect to the wafer 100 to polish the wafer. Further, at the time of polishing, the polishing film 22 may be reciprocated or continuously moved at a predetermined speed by reels 24*a*, 24*b* to add, to the aforementioned sliding rotation, a sliding motion based on relative speeds in a direction of the thickness of the wafer, thereby increasing a polishing rate.

As the polishing film 22, there may be used a polishing film having a surface serving as a polishing surface onto which diamond abrasive particles or SiC is bonded, for example. Abrasive particles to be bonded to the polishing film are selected according to the type of substrate or the required performance, and a diamond having a grain size of #4000 to #12000 or SiC having a grain size of #4000 to #10000 can be used as the abrasive particles to be bonded to the polishing film.

As shown in FIG. 6, when the elastic member 21 is pressed on a reverse face of the polishing film 22, a tension T is produced in the elongated elastic member 21. A pressure P is applied from the polishing film 22 to the bevel portion of the wafer 100 by the tension T in the elastic member 21. The magnitude of the pressure P is expressed by $P=T/(\rho W)$, where W is the width of the polishing film 22, $\rho$ is the radius of curvature of the bevel portion in a cross-section, and the thickness D of the polishing film 22 is sufficiently smaller than the radius $\rho$ of curvature.

The pressing plate 23 is disposed between the projecting portions 20*a* and 20*b* of the support portion 20 and is movable in the radial direction of the wafer 100. When the pressing plate 23 moves toward the center of the wafer 100, the elastic member 21 and the polishing film 22 are also pressed onto the edge portion of the wafer 100.

The chemical liquid supply nozzles 4 are disposed near the polishing heads 2, and a chemical liquid or pure water is supplied from the chemical liquid supply nozzles 4 to the bevel portion and the edge portion of the wafer 100. Further, the gas ejection nozzles 5 are disposed radially around the center of the water 100, and eject a gas toward the device-formed surface of the wafer 100 at the time of polishing to prevent polishing wastes produced during polishing from contaminating the device-formed surface. If the gas ejection nozzles 5 are provided not only below the device-formed surface, but also above a reverse face (i.e., an upper surface in FIG. 4) of the wafer 100, then the wafer 100 can be cleaned more effectively.

Figure 7A:
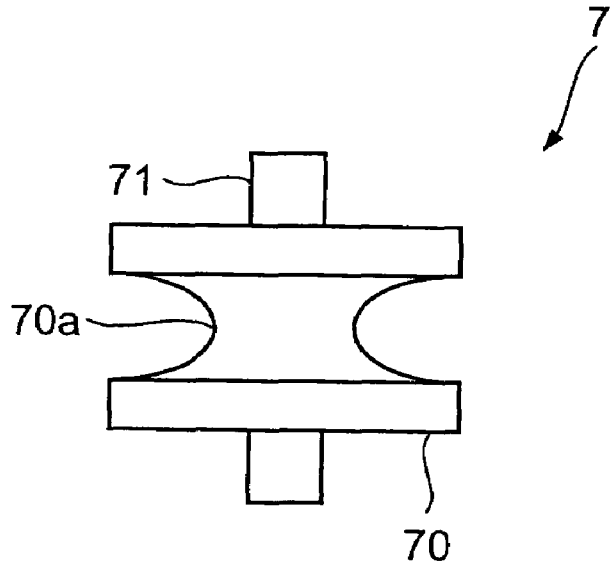
FIG. 7A is a front view showing a grinding wheel of the polishing unit shown in FIG. 3.
Figure 7B:
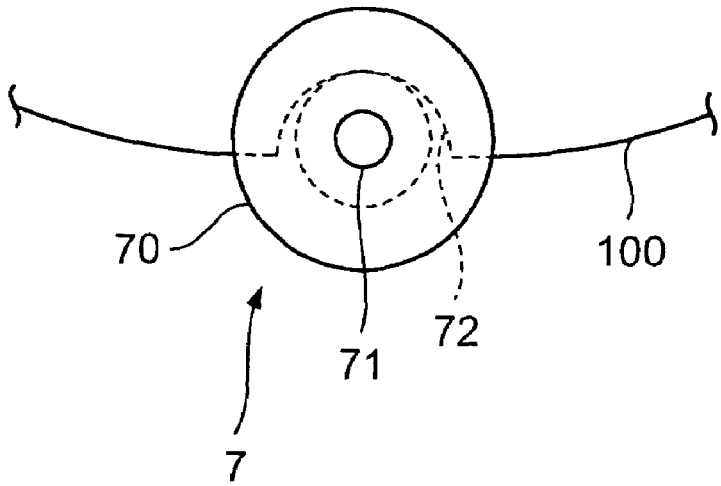
FIG. 7B is a plan view showing the grinding wheel when it polishes a notch of a semiconductor wafer.

FIG. 7A is a front view showing the grinding wheel 7 shown in FIG. 3, and FIG. 7B is a plan view showing the grinding wheel 7 when it polishes the notch of the wafer 100. As shown in FIGS. 7A and 7B, the grinding wheel 7 comprises a wheel 70 having a groove 70*a* formed so as to correspond to shapes of the notch and the bevel of the wafer 100, and a rotation axis 71 for rotating the wheel 70. For example, diamond abrasive particles having a grain size of about #10000 are bonded onto the groove 70*a* of the wheel 70.

When the notch 72 of the wafer 100 is polished by the grinding wheel 7, the notch 72 of the wafer 100 is detected by the notch sensor 6, and the rotation of the wafer 100 is stopped so that the notch 72 is positioned at the location of the grinding wheel 7. Then, as shown in FIG. 7B, the groove 70*a* of the wheel 70 of the grinding wheel 7 is aligned with the notch 72, and the wheel 70 is rotated about the rotation axis 71. At that time, the rotation axis 71 is moved in vertical and horizontal directions to polish the notch 72 of the wafer 100.

Next, there will be described a method of removing roughness produced on a surface of a bevel portion and an edge portion of a semiconductor wafer (Si wafer) when deep trenches in a trench capacitor are formed by an RIE method with the use of the polishing unit having the aforementioned arrangements. Such a trench capacitor is used for a memory cell of a DRAM, for example.

Figure 1B:
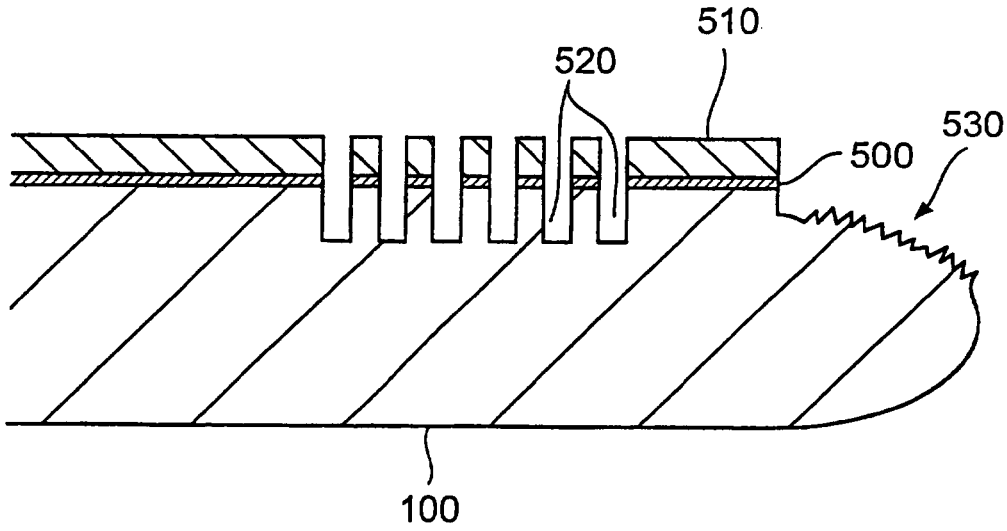
FIG. 1B (PRIOR ART)

First, deep trenches are formed on a surface of a semiconductor wafer by an RIE process (see FIGS. 1A and 1B). For example, a SiN film 500 has a thickness of 200 nm, a $SiO_2$ film 510 has a thickness of 90 nm, and deep trenches 520 have an opening diameter of 0.25 μm and a depth of 7 μm. With this RIE process, needle projections 530 as shown in FIG. 1B are formed on the surface of the semiconductor wafer. These needle projections 530 are removed with the aforementioned polishing unit.

First, the semiconductor wafer 100 is held so as to be rotatable within a horizontal plane by the rollers 1 while the device-formed surface faces downwardly. Next, the polishing head 2 is moved toward the center of the wafer 100 and pressed against the wafer 100 so that the bevel portion of the wafer 100 is sandwiched by the polishing film 22 of the polishing head 2. Further, the pressing plate 23 of the polishing head 2 is moved toward the center of the wafer 100 so as to vertically press a horizontal surface of the pressing plate 23 against the edge portion region, so that the polishing film 22 is brought into contact with the edge portion region under a pressure of about 98 kPa, for example. In this manner, it is possible to polish a region of several millimeters which includes the edge portion of the device-formed surface. At that time, a chemical liquid or pure water is supplied from the chemical liquid supply nozzles 4 to contacting portions of the bevel portion and the edge portion of the wafer 100 with the polishing film 22. The wafer 100 is rotated by the rotation of the rollers 1, and the bevel portion and the edge portion of the wafer 100 and the polishing film 22 of the polishing head 2 are brought into sliding contact with each other to wet-type polish the bevel portion and the edge portion of the wafer 100.

Further, a gas such as air or nitrogen is ejected at a flow rate of, for example, 5 m/s or more, at a slight angle with respect to the device-formed surface from the gas ejection nozzles 5 disposed radially below the device-formed surface of the wafer 100. Thus, the device-formed surface of the wafer 100 is prevented from being contaminated by polishing wastes produced during polishing.

Then, entire surfaces of the bevel portion and the edge portion of the notch 72 of the wafer 100 are polished with the use of the notch sensor 6 and the grinding wheel 7, as described above.

In this manner, the bevel portion and the edge portion of the wafer 100 are polished. If the elastic member 21 deteriorates with age, then it may lose the elasticity or be plastically deformed so that its entire length is lengthened, thereby lowering the tension of the elastic member 21 at the time of polishing. If the tension of the elastic member 21 is lowered, then a polishing load is lowered, and a polishing rate is also reduced so as to lower the polishing efficiency. Further, if the tension of the elastic member 21 is lowered, then the polishing rate is changed, so that a desired polishing profile cannot be achieved.

Here, the deterioration of the elastic member 21 means a lengthened natural length, and a reduced Young's modulus, which are caused by plastic deformation. If stresses of tension are accumulated, plastic deformation of the elastic member 21 is caused even though the elastic member 21 is an elastic body. The length (natural length) of the elastic member 21, when no tension is applied thereto, becomes slightly longer. Further, it has been found that if stresses of tension are accumulated, then the Young's modulus of the elastic member 21 becomes slightly smaller.

The deterioration of the elastic member 21 can be improved to some degree by selecting an elastic member 21 made of a material unlikely to deteriorate, or by increasing the thickness of the elastic member 21 to reduce the tension applied per area. However, it is impossible to completely eliminate the deterioration of the elastic member 21.

Therefore, in a case where the wafer 100 is polished while a distance D (see FIG. 6) by which the wafer 100 presses the polishing film 22 and the elastic member 21 is kept constant (which will hereinafter be referred to as a constant position method), the following problems arise. This constant position method comprises predetermining a position at which the elastic member 21 can press the polishing film 22 under a predetermined force, moving the polishing head 2 to this position at the time of polishing, and polishing the wafer. According to the constant position method, a predetermined tension is applied to the elastic member 21 at the beginning of the polishing operation. As time passes, the tension is gradually reduced because of the deterioration of the elastic member 21 as described above. Therefore, as time passes, there arises a problem in that a polishing rate is gradually reduced.

When natural rubber having a Young's modulus of 0.6 MPa and a cross-section of 13 $mm^2$ was used as the elastic member 21, it was found that a cumulative used time of 10 hours reduced a tension applied to the elastic member 21 by 10%. Thus, from around a cumulative used time of 10 hours, rough polishing for one minute cannot completely remove needle projections formed at a bevel portion. Accordingly, it becomes necessary to lengthen the processing time.

In this point of view, according to the present embodiment, the air cylinder 3 is used so that the elastic member 21 presses the polishing film 22 continuously under a constant force F (a constant force method). Specifically, the air cylinder 3 presses the support portion 20 and the elastic member 21 so as to maintain a pressing force applied to the polishing film 22 constant during polishing. Thus, even if the elastic member 21 has been elongated due to deterioration, the air cylinder 3 presses the support portion 20 and the elastic member 21 as a result of the elongation of the elastic member 21, so that the pressure which is applied to the bevel portion and the edge portion by the polishing film 22 does not change. Therefore, a polishing rate by the polishing film 22 can continuously be kept constant, irrespective of deterioration of the elastic member 21, and changes in the tension applied to the elastic member 21 can almost be eliminated, thereby achieving a stable polishing process.

The magnitude of the aforementioned constant force F is determined such that the elastic member 21 is deformed so as to have a predetermined tension T. Specifically, in FIG. 6, the pressing force F is adjusted so that a relationship $F=2T\cos\theta$ holds. Here, $\theta$ represents an angle between a surface of the wafer 100 and the elastic member 21.

It is assumed that half of the overall length of the elastic member 21 when a constant force F is applied thereto is defined as L (see FIG. 6), and that the elastic member 21 is elongated due to the deterioration by $\Delta L$. If the elastic member 21 elongated by $\Delta L$ reduces the angle $\theta$ by $\Delta\theta$ and the tension T by $\Delta T$, then the aforementioned relationship $F=2T\cos\theta$ holds according to the constant force method. Since the force F does not change (or is set to be constant), a relationship $\Delta T/T=\Delta\theta\tan\theta$ holds. Further, another relationship $\Delta\theta=(\Delta L/L)\tan\theta$ also holds. Consequently, a relationship $\Delta T/T=(\Delta L/L)\tan^2\theta$ holds. Here, in consideration of the fact that if the angle $\theta$ is 15 degrees, then $\Delta L/L$ becomes less than a ratio of the reduction of the tension in the constant position method, a ratio $\Delta T/T$ of the reduction of the tension in the constant force method is smaller than 7% of the ratio of the reduction of the tension in the constant position method and can almost be ignored. Actually, according to the constant force method, reduction of the tension applied to the elastic member 21 was not found even after a cumulative used time of 10 hours. Thus, it becomes unnecessary to lengthen the processing time.

In order to achieve uniform polishing over an entire bevel portion, it is necessary to reliably fit the polishing film 22 along a curved shape of the bevel portion. Specifically, the curvature of the cross-section of the bevel portion varies depending on the type of semiconductor wafers. In a case of an 8-inch wafer, although the curvature of the cross-section of the bevel portion is about 1/(360 μm) on average, it may partly be a considerably large value, e.g., 1/(120 μm). In order to fit the polishing film 22 along a curved shape of the bevel portion having such a large curvature, the polishing film 22 should have such a flexibility that the polishing film 22 is not plastically deformed, i.e., not folded or bent, by a curved surface, having a (maximum) curvature, of the cross-section of the bevel portion.

Figure 8:
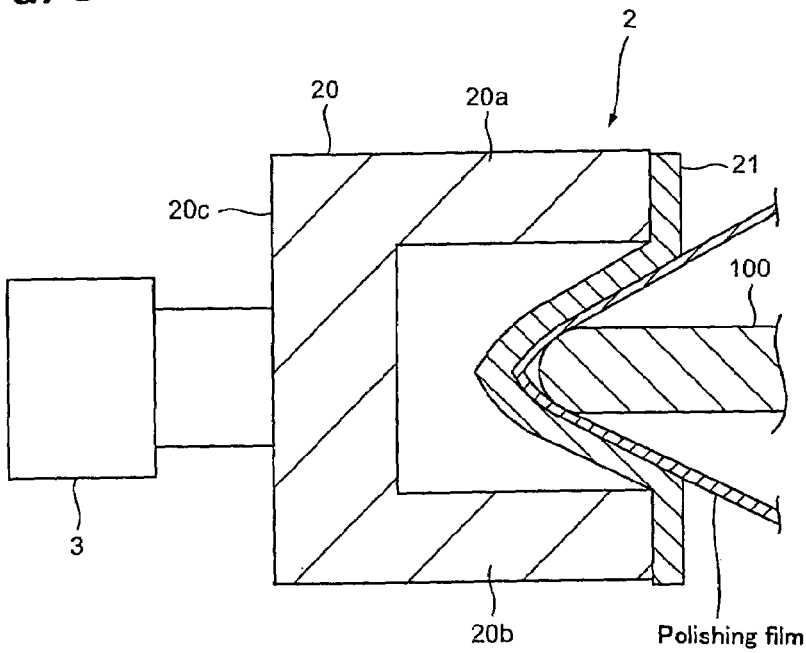
FIG. 8 is a schematic cross-sectional view showing a state of a polishing film which is folded and bent.

The flexibility of a polishing film is determined by the film material and the thickness of the polishing film. In a case of using PET, which is generally used as a material of a polishing film, when a polishing film having a thickness of 75 μm or more is to be fitted along a curved surface of the bevel portion, the polishing film may be folded and bent as shown in FIG. 8. If the polishing film is thus folded and bent, then portions that are unlikely to contact with the polishing film are produced at the bevel portion to reduce a polishing rate at those portions, so that the bevel portion of the wafer 100 cannot be polished uniformly. In a state in which the polishing film is thus folded and bent, for example, a rough polishing for one minute cannot completely remove needle projections formed at a portion at which the polishing film 22 is folded and bent. Therefore, in order to completely remove needle projections over the entire bevel portion, it is necessary to lengthen the processing time, for example, to 2 minutes. This causes a lower throughput.

Therefore, according to the present embodiment, by forming the polishing film into a thin film, such a flexibility that the polishing film is not folded or bent by a curved shape, having a (maximum) curvature, of the cross-section of the bevel portion is provided to the polishing film. In the case where PET was used as a material of the polishing film, it was found that if the thickness of the polishing film was 50 μm or less, then the polishing film could be fitted along a curved shape, having a (maximum) curvature, of the cross-sectional bevel without being folded or bent. If the material of the polishing film is not PET, the thickness of the film, which can be fitted along a curved shape having a (maximum) curvature of the bevel portion without being folded or bent, is different from the above as a matter of course.

As described above, according to the present embodiment, since a thin polishing film is used as the polishing film 22, the polishing film 22 is not folded or bent at the bevel portion of the wafer 100. Therefore, the polishing film 22 can be reliably fitted along a curved shape of the bevel portion of the wafer 100, and hence it is possible to uniformly polish the bevel portion of the wafer 100. In the present embodiment, by using a thin polishing film as the polishing film 22, the polishing film 22 is fitted along a curved shape of the bevel portion of the wafer 100. However, similar effects can be achieved by using a polishing film made of a material having a high flexibility.

In the present embodiment, the polishing film 22 is pressed via the elastic member 21 against the wafer 100 as described above. However, if the polishing film 22 is pressed directly against the wafer 100 without the elastic member 21, then the polishing film 22 contacts only with a vertically central portion of the wafer 100, and the contacting length is at most about 10 mm, so that the contacting area cannot be made large. Further, because it is impossible to absorb subtle displacements of the bevel portion due to the rotation of the wafer 100, it is difficult to dynamically and stably apply a pressure to the bevel portion of the rotating wafer 100.

As described in the present embodiment, in a method of pressing the polishing film 22 via the elastic member 21 against the wafer 100, a pressure P applied to the bevel portion of the wafer 100 by the polishing film 22 is represented by $P=T/(\rho W)$ as described above. When the cross-section of the bevel portion is fully round, the pressure applied to the bevel portion can be made uniform. Thus, when the polishing film 22 is pressed via the elastic member 21 against the wafer 100, it is possible to extend a portion contributing to polishing to increase the polishing rate, and to lessen the dispersion of pressures on the contacting surface to make the amount of polishing uniform.

Figure 9:
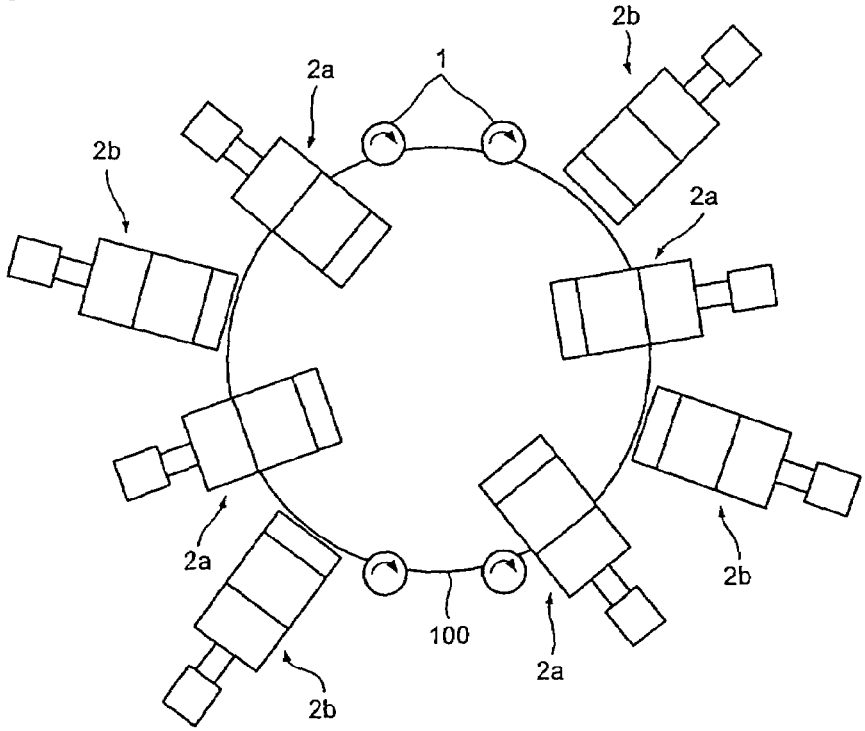
FIG. 9 is a schematic plan view showing a polishing unit used for polishing a bevel portion and an edge portion of a semiconductor wafer.

Removal of needle projections formed at a bevel portion and an edge portion was performed under the following conditions with use of a polishing unit having the above arrangements. In this example, as shown in FIG. 9, there was used a polishing unit having four polishing heads **2*a* provided in a circumferential direction for rough polishing, and four polishing heads 2*b*** provided in a circumferential direction for final polishing.

A polishing film in which diamond particles having a grain size of #4000 were bonded onto a PET film having a thickness of 25 μm by a urethane-type adhesive was used as a polishing film for rough polishing. A polishing film in which diamond particles having a grain size of #10000 were bonded onto a PET film having a thickness of 25 μm by a urethane-type adhesive was used as a polishing film for final polishing. The respective polishing films had a width of 30 mm. Further, the tension T of the elastic member 21 was set to be 9.8 N, and the angle θ was set to be 15 degrees. Furthermore, the rotational speed of the wafer 100 was set to be 100 $min^{-1}$. At the time of polishing, pure water was supplied from the respective chemical liquid supply nozzles 4 at a rate of 10 ml/min.

First, the polishing films for rough polishing in the polishing heads 2*a* were brought into contact with the wafer at four points along a circumferential direction to polish the wafer for one minute. By this rough polishing, the needle projections 530 were removed from the wafer 100. Next, for the purpose of removing damage due to polishing, the polishing heads 2*a* for rough polishing were interchanged with the polishing heads 2*b* for final polishing, and polishing was performed with the polishing films for final polishing for one minute. By this final polishing, polishing scratches remaining on the surface were completely removed, so that the bevel surface was made a mirror surface having an average roughness Ra of several nanometers or less.

Next, the notch 72 of the wafer 100 was polished. While the grinding wheel 7 was rotated at a rotational speed of 1000 $min^{-1}$, the notch 72 of the wafer 100 was polished for 30 seconds. Thus, needle projections at the notch were completely removed.

Then, in another unit, while a PVA sponge or the like was brought into sliding contact with the wafer 100, mainly the bevel portion and the edge portion were cleaned with pure water or a surface active agent aqueous solution. After being rinsed, the wafer was dried, and the process was completed.

In this manner, by removing the needle projections 530 at the bevel portion and the edge portion of the wafer 100 with the use of the polishing film 22, it becomes unnecessary to protect the device-formed surface with a resist, which has been essential in the conventional CDE method. As a result, it is possible to omit two processes including applying a resist for protection and removing the resist after removing needle projections, thereby resulting in an improved throughput.

Figure 2A:
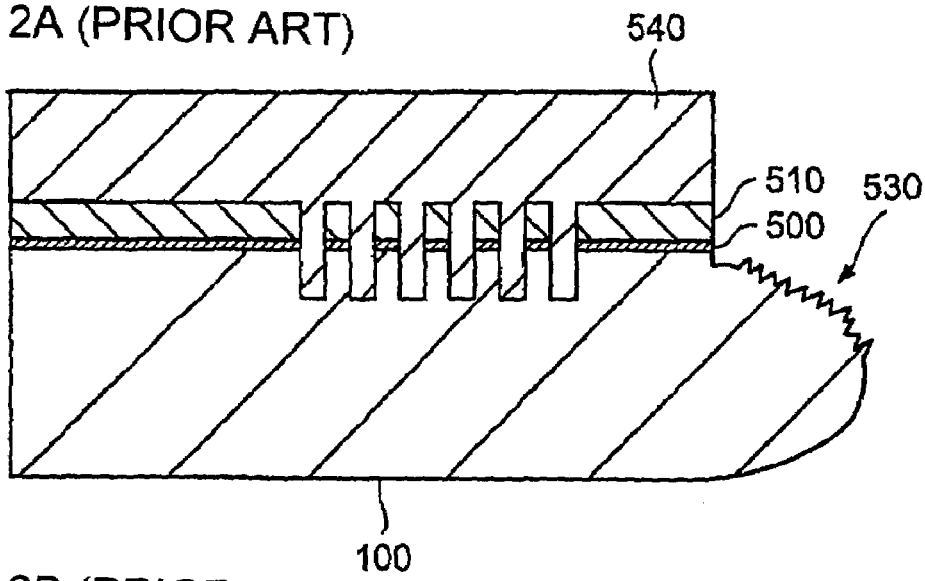
FIG. 2A (PRIOR ART)
FIGS. 2A through 2C are cross-sectional views showing a process of removing needle projections produced at the time of forming the deep trenches.
Figure 2B:
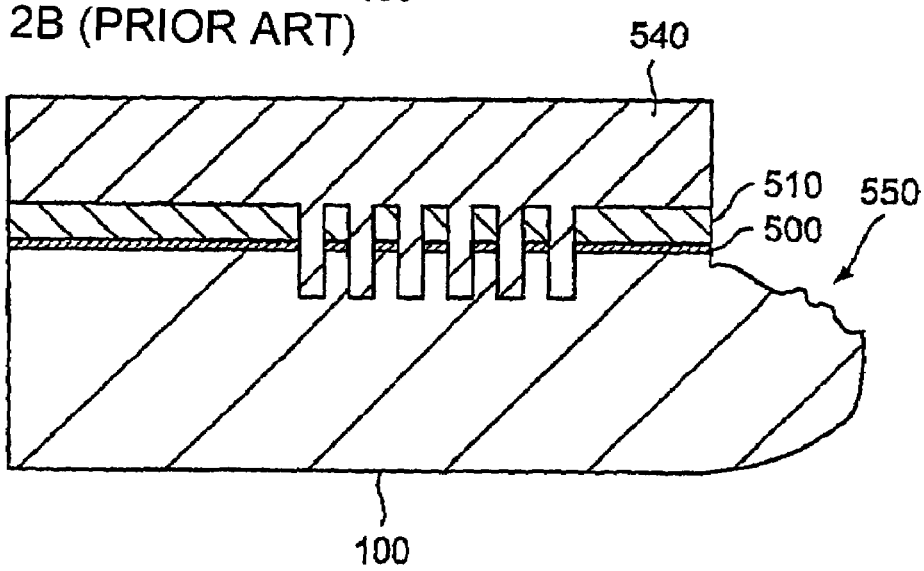
FIG. 2B (PRIOR ART)
Figure 2C:
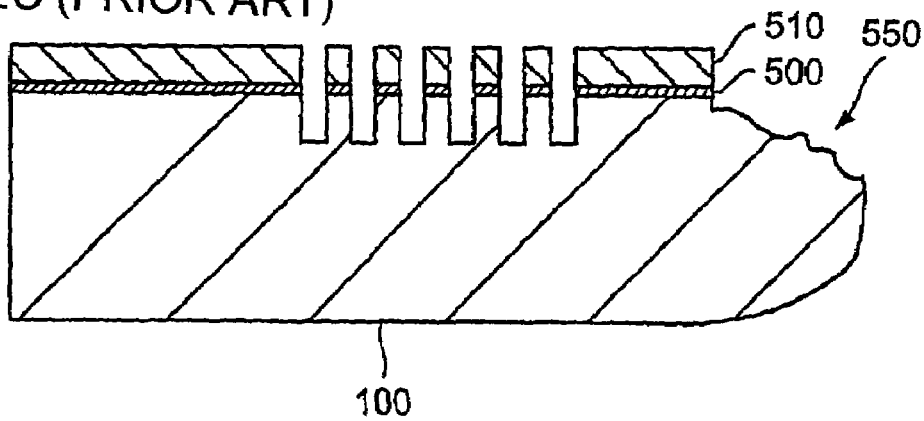
FIG. 2C (PRIOR ART)
Figure 10:
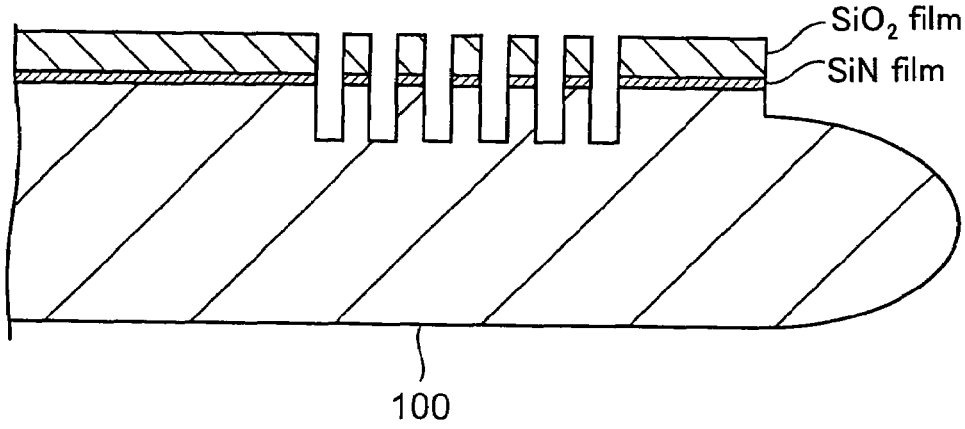
FIG. 10 is a cross-sectional view showing a surface shape of a semiconductor wafer after polishing with use of the polishing unit shown in FIG. 9.

Further, a surface on the bevel portion and the edge portion of the wafer 100 from which the needle projections 530 have been removed becomes a smooth surface as shown in FIG. 10. Therefore, the aforementioned problems in the CDE method can be solved. Specifically, in the conventional CDE method, irregularities 550 are formed depending on variation of the heights of the needle projections 530 after the needle projections are removed, as shown in FIG. 2C, and dust tends to accumulate in the irregularities 550 during subsequent processes such as CMP. However, according to the present invention, this problem can be solved.

Further, when a cleaning section for cleaning the wafer 100 is incorporated into the aforementioned substrate processing apparatus, the processing time per one wafer can be shortened to about 3 minutes. Since the processing time can be shortened as compared to the fact that the conventional CDE method requires about 5 minutes, the throughput can be improved.

Furthermore, since the aforementioned polishing unit and substrate processing apparatus have a simple arrangement of components, the cost of the apparatus can be reduced. Moreover, because only pure water and a trace of chemical liquid are used as materials, the running cost can be largely reduced. Thus, the present invention has great advantages in reducing costs.

Further, in the present embodiment, not only pure water, but also a chemical liquid for wet-etching silicon, e.g., KOH aqueous solution or alkali ionic water, may be used as a liquid to be supplied for wet-type polishing. Furthermore, a surface active agent aqueous solution may be used. It can be expected that the use of these chemical liquids improves polishing characteristics such as polishing rate and surface flatness, depending on the material and the size of abrasive particles of the polishing film 22.

Next, a substrate processing apparatus according to a second embodiment of the present invention will be described below. A substrate processing apparatus in the present embodiment serves to remove a Ru film attached to a bevel portion, an edge portion, and a reverse face of a semiconductor wafer when a Ru film to be used as a capacitor electrode is deposited on a device-formed surface by a CVD method.

Figure 11:
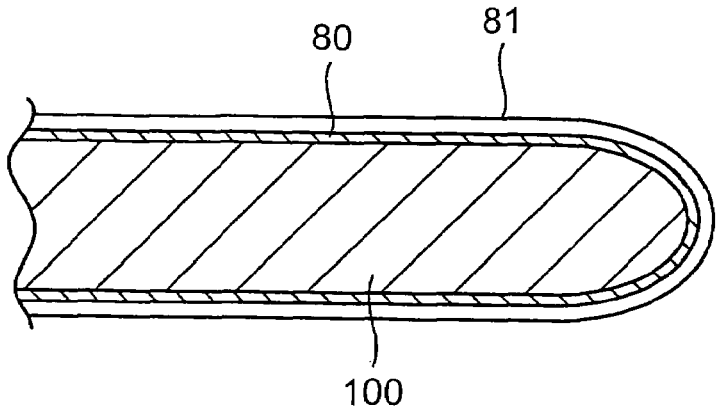
FIG. 11 is a cross-sectional view showing a semiconductor wafer (Si wafer) on which a Ru film is deposited.

As shown in FIG. 11, when a Ru film 81 to be used as a lower capacitor electrode is deposited with a thickness of 30 nm on a silicon nitride film 80 deposited on a semiconductor wafer 100 by a batch-type CVD method, the Ru film 81 is deposited not only on a device-formed surface, but also on a bevel portion, an edge portion, and a reverse face with a thickness of about 30 nm. A capacitor using this type of Ru film 81 comprises, for example, a three-dimensional capacitor, and is used for DRAM or FeRAM. As described above, it is necessary to remove the Ru film 81 attached to the bevel portion, the edge portion, and the reverse face because it causes contamination to a device in a next process.

Figure 12:
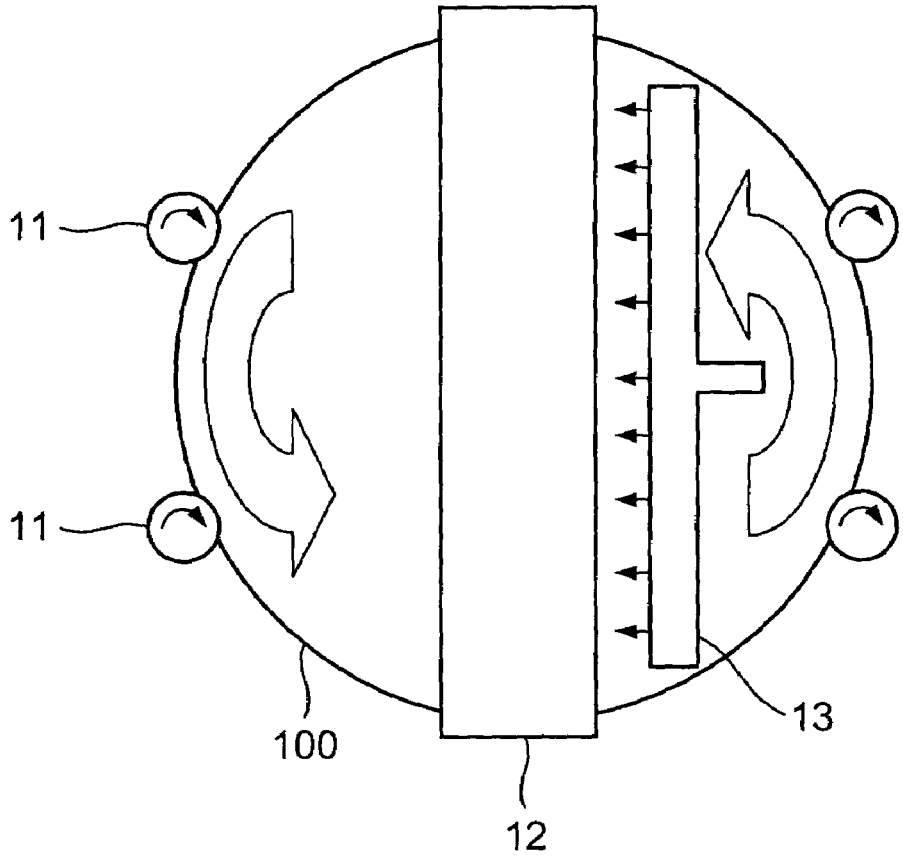
FIG. 12 is a schematic plan view showing a second polishing unit of a substrate processing apparatus according to a second embodiment of the present invention.

Therefore, the Ru film attached to the bevel portion, the edge portion, and the reverse face of the semiconductor wafer is removed with use of the substrate processing apparatus of the present embodiment. The substrate processing apparatus in the present embodiment comprises, in addition to a (first) polishing unit described in the first embodiment, a second polishing unit for removing a Ru film 81 attached to a reverse face of a wafer 100. FIG. 12 is a schematic plan view showing the second polishing unit in the present embodiment, and FIG. 13 is a front cross-sectional view of FIG. 12.

Figure 13:
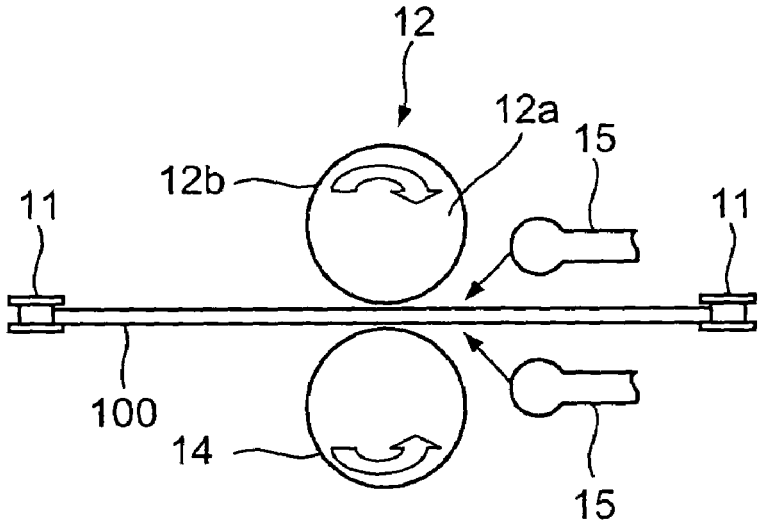
FIG. 13 is a front cross-sectional view of the second polishing unit shown in FIG. 12.

A shown in FIGS. 12 and 13, the second polishing unit comprises a plurality of rollers 11 for rotatably holding a wafer 100, a polishing roll (polishing head) 12 having a polishing film 12*b* wound on an elastic body 12*a*, a chemical liquid supply nozzle 13 (not shown in FIG. 13) in the form of a shower nozzle, a support roll 14 made of PVA sponge, and cleaning liquid supply nozzles 15 (not shown in FIG. 12) for supplying a cleaning liquid to a wafer 100. The wafer 100 is set so that a device-formed surface thereof faces downwardly.

The polishing roll 12 has the polishing film 12*b* wound on the cylindrical elastic body 12*a* made of elastic rubber, urethane foam, or the like. For a wafer having a diameter of 20.32 cm (8 inches), the polishing roll 12 has, for example, a diameter of about 30 mm and a length of about 210 mm. Further, the chemical liquid supply nozzle 13 is disposed near the polishing roll 12 disposed above a reverse face (upper surface in FIG. 13) of the wafer 100. A chemical liquid is dropped onto the reverse face of the wafer 100 from the chemical liquid supply nozzle 13. While the support roll 14 disposed below the wafer 100 is rotated, it is brought into contact with the device-formed surface of the wafer 100. A load of the polishing roll 12 is supported by the support roll 14.

In the second polishing unit thus constructed, the wafer 100 is held so as to be rotatable within a horizontal plane by the rollers 11 while the device-formed surface faces downwardly. Next, while the polishing roll 12 is rotated, it is brought into contact with the reverse face of the wafer 100 by a pressing mechanism, which is not shown. At that time, a chemical liquid is dropped from the chemical liquid supply nozzle 13. Further, while the support roll 14 is rotated, it is brought into contact with the device-formed surface of the wafer 100, and a cleaning liquid is supplied to the front and reverse faces of the wafer 100 from the cleaning liquid supply nozzles 15. The wafer 100 is rotated by the rotation of the rollers 11, and the reverse face of the wafer 100 and the polishing roll 12 are brought into sliding contact with each other to wet-type polish the reverse face of the wafer 100. The front face (device-formed surface) may be polished by the polishing roll 12.

Removal of a Ru film 81 attached to a bevel portion and an edge portion was performed under the following conditions with use of the substrate processing apparatus of the present embodiment. In this example, a polishing unit having eight polishing heads disposed in a circumferential direction was used as the first polishing unit.

A polishing film in which diamond particles having a grain size of #10000 were bonded onto a PET film having a thickness of 25 μm by a urethane-type adhesive was used as a polishing film 22. The polishing film 22 had a width of 30 mm. The tension of the elastic member 21 was set to be 9.8 N, and the angle θ was set to be 15 degrees. Further, the rotational speed of the wafer 100 was set to be 100 $min^{-1}$. At the time of polishing, pure water was supplied from the respective chemical liquid supply nozzles 4 at a rate of 10 ml/min.

First, the polishing films 22 in the polishing heads 2 were brought into contact with the wafer at eight points along a circumferential direction to polish the wafer for one minute. By this polishing operation, a Ru film 81 attached to the bevel portion and the edge portion could be completely removed. Next, the notch 72 of the wafer 100 was polished. While the grinding wheel 7 was rotated at a rotational speed of 1000 $min^{-1}$, the notch 72 of the wafer 100 was polished for 30 seconds. Thus, the Ru film 81 attached to the bevel portion and the edge portion of the notch 72 was completely removed.

Next, removal of a Ru film 81 attached to a reverse face was performed under the following conditions with use of a second polishing unit described above.

A polishing film in which diamond particles having a grain size of #10000 were bonded onto a PET film by a urethane-type adhesive was used as a polishing film 12*b* of the polishing roll 12. The pressing force of the polishing roll 12 was set to be 9.8 N, and the rotational speed of the polishing roll 12 was set to be 100 $min^{-1}$. The rotational speed of the wafer 100 was set to be 100 $min^{-1}$, and pure water was supplied from the chemical liquid supply nozzle 13 at a rate of 200 ml/min. Further, pure water was supplied from the respective cleaning liquid supply nozzles 15 at a rate of 1000 ml/min.

Figure 14:
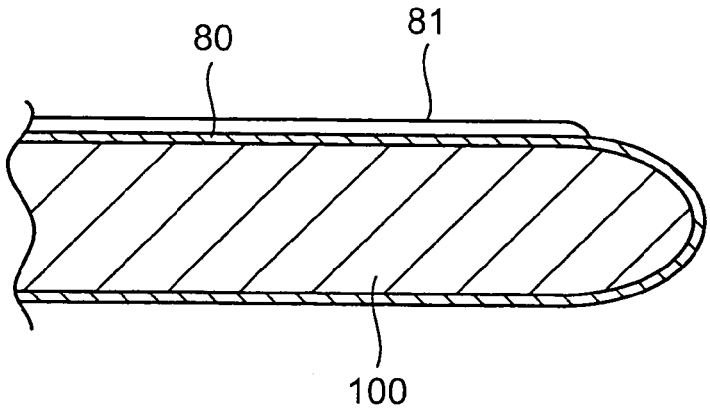
FIG. 14 is a cross-sectional view showing a surface shape of a semiconductor wafer after polishing with use of the substrate processing apparatus according to the second embodiment of the present invention.

First, the polishing roll 12 was brought into contact with the reverse face of the wafer 100 to polish the wafer for 2 minutes. By this polishing operation, the Ru film 81 attached to the reverse face was completely removed as shown in FIG. 14.

Then, in another unit, while a PVA sponge or the like was brought into sliding contact with an entire surface of the wafer 100 including the bevel portion, the wafer was cleaned with pure water or a surface active agent aqueous solution. After being rinsed, the wafer was dried, and the process was completed.

The wafer 100 was analyzed with ICP after the Ru film was thus removed. As a result, it was confirmed that Ru contamination was reduced to less than $10^{10}$ atoms/$cm^2$ on an underlying silicon nitride film 80 exposed by removal of the Ru film 81.

With a conventional wet-etching method, for example, in a case where a diammonium cerium nitrate 20% aqueous solution is used as a chemical liquid, it takes 5 minutes or more to reduce Ru contamination even to less than $10^{11}$ atoms/$cm^2$, and in order to reduce Ru contamination to less than $10^{10}$ atoms/$cm^2$, it is necessary to wet-etch a underlying silicon nitride film 80 with another chemical liquid such as a dilute hydrogen fluoride for about 2 minutes. Therefore, with the conventional method, it takes 7 minutes or more per wafer to remove a Ru film on a bevel portion, an edge portion, and a reverse face.

On the contrary, when a Ru film is removed with a substrate processing apparatus according to the present invention, removal of the Ru film can be completed in about 3.5 minutes even if the bevel portion, the edge portion, and the reverse face are separately processed. The first polishing unit for processing a bevel portion and an edge portion, and the second polishing unit for processing a reverse face may be integrally combined with each other as long as they do not interfere with each other. When these units are integrally combined with each other, removal of the Ru film on a bevel portion and an edge portion and removal of the Ru film on a reverse face can be simultaneously performed, thereby reducing the processing time to about 2.5 minutes to remarkably improve a throughput.

Further, since the aforementioned polishing unit and substrate processing apparatus have a simple arrangement of components, the cost of the apparatus can be reduced. Moreover, because only pure water and a trace of chemical liquid are used as materials, the running cost can be largely reduced. Thus, the present invention has great advantages in reducing costs.

Further, in the present embodiment, not only pure water, but also a chemical liquid for wet-etching a Ru film, e.g., an oxidizing agent such as a diammonium cerium nitrate aqueous solution or an ammonium persulfate aqueous solution, may be used as a liquid to be supplied for wet-type polishing. It can be expected that the use of these chemical liquids improves a polishing rate.

Removal of a contaminating film by polishing in the present embodiment also has mechanical removal effects due to abrasive particles. Therefore, the present invention is applicable to the removal of a chemically stable film and can remove components of the chemically stable film which are dispersed into an underlying layer by removing a portion of the underlying layer. Thus, a contaminating film which can be removed by a substrate processing apparatus according to the present invention are not limited to a Ru film as described above and can be extended to a Cu film, a PZT film, a BST film, and the like, and also to generally new material films which will be introduced into manufacturing processes of semiconductor devices.

Figure 15:
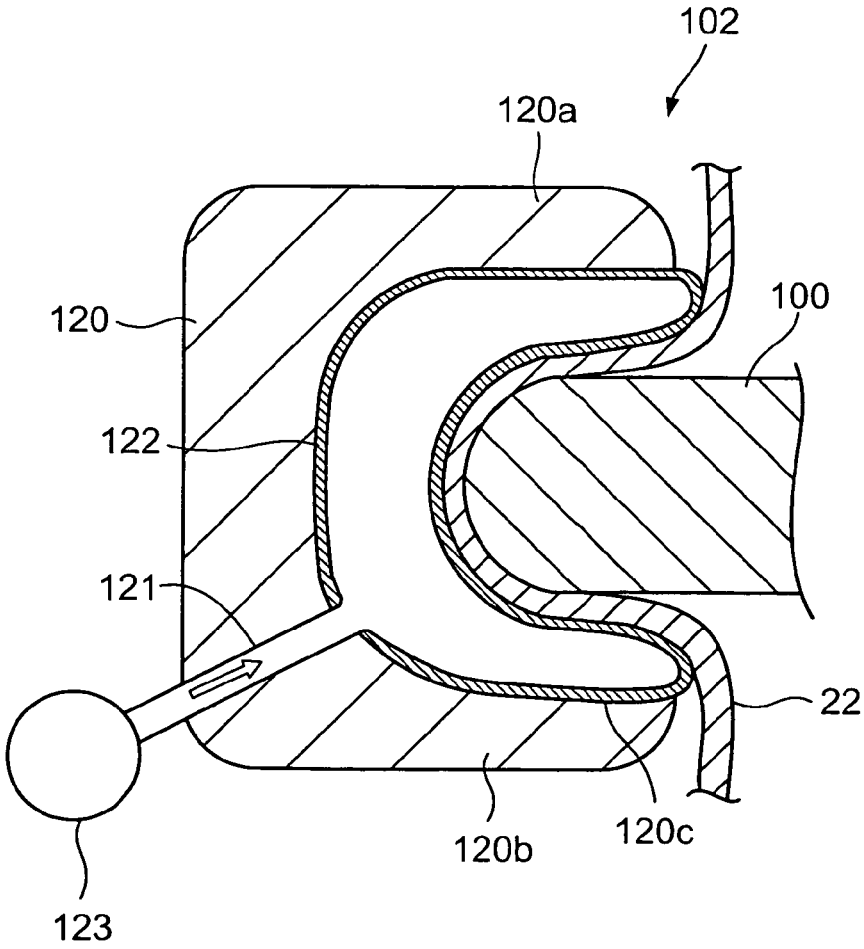
FIG. 15 is a schematic cross-sectional view showing a polishing head of a substrate processing apparatus according to a third embodiment of the present invention.

Next, a substrate processing apparatus according to a third embodiment of the present invention will be described below. FIG. 15 is a schematic view showing a polishing head in a substrate processing apparatus according to the present embodiment. As shown in FIG. 15, the polishing head 102 in the present embodiment comprises a support portion 120 having two projecting portions 120*a*, 120*b*, and a fluid bag 122 into which a fluid is supplied through a fluid passage 121. The fluid bag 122 is formed of a material having a flexibility, such as thin rubber or soft vinyl, so that it can be deformed in accordance with an internal pressure thereof The fluid passage 121 is connected to a fluid supply source 123, and a fluid such as a gas (air or the like) or a liquid (water or the like) is supplied from the fluid supply source 123 to the fluid bag 122. The fluid supply source 123 can supply a fluid under a desired pressure to the fluid bag 122, and the internal pressure of the fluid bag 122 is adjusted by the pressure of the fluid supplied thereto.

The fluid bag 122 is received in a recess 120*c* formed between the projecting portions 120*a* and 120*b* of the support portion 120 and is supported by the recess so that the fluid bag 122 is not ejected to the exterior of the support portion 120. A polishing film 22 is supported by the fluid bag 122.

The polishing head 2 in the polishing unit of the first embodiment is replaced with the polishing head constructed as described above, and the polishing film 22 is pressed against the wafer 100 under a predetermined pressing force. By rotating the wafer 100, the bevel portion and the polishing film 22 are brought into sliding contact with the wafer 100 to polish the bevel portion. The polishing film 22 may be moved with respect to the wafer 100 to polish the wafer.

In the present embodiment, by supplying a pressurized fluid to the fluid bag 122, the fluid bag 122 supporting the polishing film 22 is deformed so that the polishing film 22 is brought into contact uniformly with the bevel portion of the wafer 100. Therefore, it is possible to uniformly polish a peripheral portion of the wafer 100.

The same polishing film as in the first embodiment may be used as the polishing film 22, and a film-like polishing cloth (e.g., SUBA-400 manufactured by Rodel Inc.) may be used as a polishing tape. When a polishing cloth is used, a polishing material or an etching liquid is supplied to a surface to be polished from a supply nozzle, which is not shown. Further, the polishing film 22 may be attached directly to the fluid bag 122, or the fluid bag 122 may be formed of the polishing film 22.

Polishing of a bevel portion and an edge portion was performed with use of the polishing head having the above arrangements. In this polishing process, a thin PET polishing film, onto which diamond particles were bonded, having a thickness of 25 μm was used as the polishing film 22. Air having a pressure of 196 kPa was supplied to the fluid bag 122 formed of fluoro rubber having a thickness of 0.1 mm to polish the bevel portion and the edge portion of the wafer 100. The rotational speed of the wafer 100 was set to be 500 $min^{-1}$. In this example, it was confirmed that the bevel portion of the wafer 100 was uniformly polished.

Figure 16:
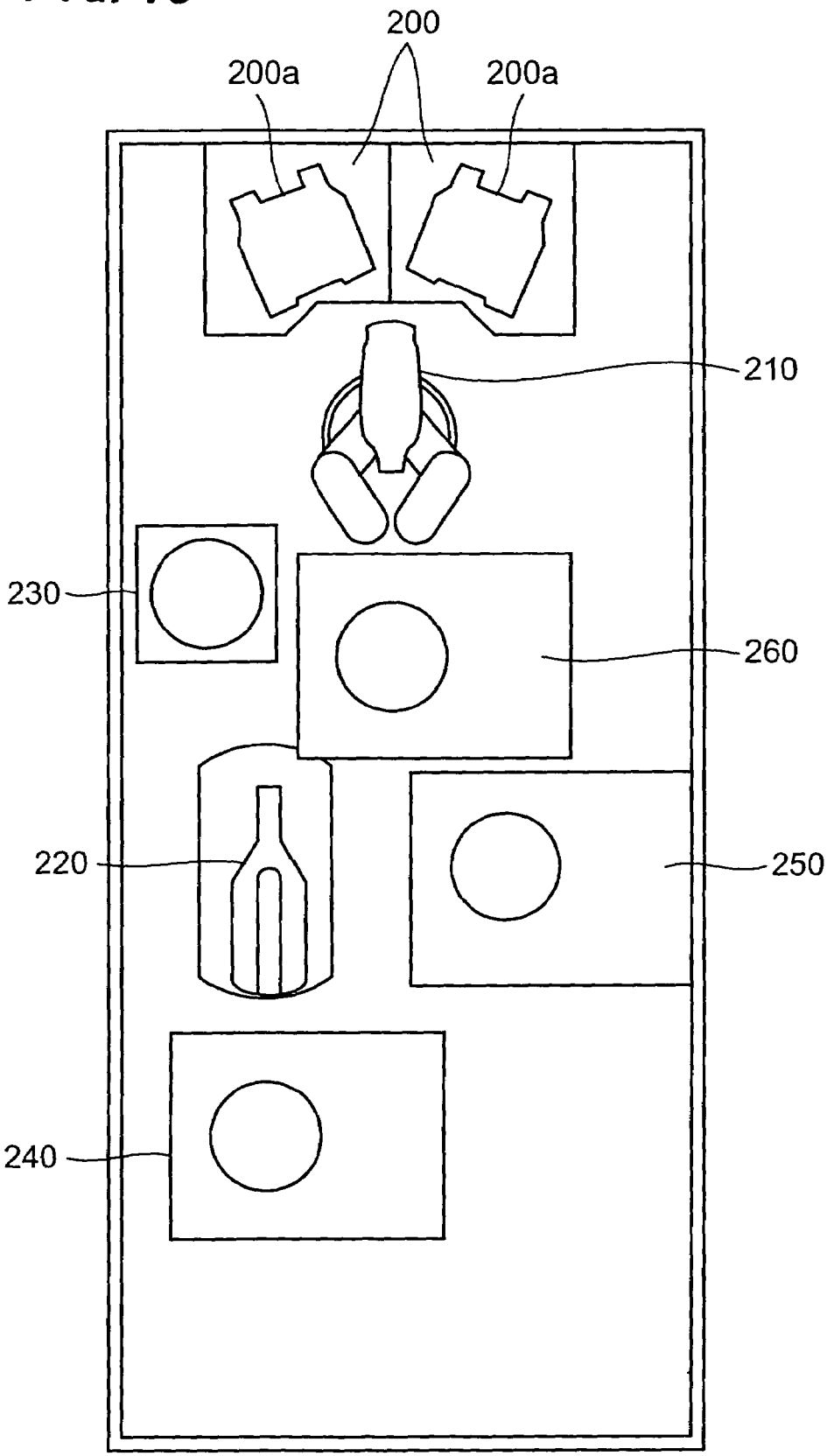
FIG. 16 is a plan view showing an example of an arrangement of a substrate processing apparatus according to the present invention.

FIG. 16 is a plan view showing an example of an arrangement of a substrate processing apparatus having the aforementioned polishing unit incorporated therein. As shown in FIG. 16, the substrate processing apparatus comprises a pair of load/unload stages 200 for placing a wafer cassette 200*a* receiving a plurality of semiconductor wafers (substrates), a first transfer robot 210 for handling a dry substrate, a second transfer robot 220 for handling a wet substrate, a temporary placing stage 230, the aforementioned polishing unit 240, and cleaning units 250, 260. The first transfer robot 210 transfers a substrate between the cassettes 200*a* on the load/unload stages 200, the temporary placing stage 230, and the cleaning unit 260. The second transfer robot 220 transfers a substrate between the temporary placing stage 230, the polishing unit 240, and the cleaning units 250, 260.

A wafer cassette 200*a* receiving wafers that have been subject to a CMP process or a Cu deposition process is transferred to the substrate processing apparatus by a cassette transfer device, which is not shown, and is placed on the load/unload stage 200. The first transfer robot 210 picks up a semiconductor wafer from the wafer cassette 200*a* on the load/unload stage 200 and places this wafer onto the temporary placing stage 230. The second transfer robot 220 receives the wafer placed on the temporary placing stage 230 and transfers the wafer to the polishing unit 240. Polishing of the bevel portion and the edge portion, and/or the reverse face is performed in the polishing unit 240.

In the polishing unit 240, during or after polishing, water or a chemical liquid is supplied from one or more nozzles, which are not shown, disposed above the wafer to clean an upper surface and an edge portion of the wafer. The cleaning liquid is performed for the purpose of maintenance of a material on the surface of the wafer in the polishing unit 240 (for example, to form a uniform oxide film while avoiding changes in properties, such as non-uniform oxidation of the wafer surface due to a chemical liquid or the like). This cleaning in the polishing unit 240 is referred to as primary cleaning.

In the cleaning units 250, 260, secondary cleaning and tertiary cleaning are performed, respectively. The wafer that has been subject to primary cleaning in the polishing unit 240 is transferred to the cleaning unit 250 or 260 by the second transfer robot 220, and is subject to secondary cleaning in the cleaning unit 250, or is subject to tertiary cleaning in the cleaning unit 260 in some cases, or is subject to secondary cleaning and tertiary cleaning in both units 250 and 260.

In the cleaning unit 250 or 260 where the wafer has finally been cleaned, the wafer is dried, and the first transfer robot 210 receives the dried wafer and returns it to the wafer cassette 200*a* on the load/unload stage 200.

In the secondary cleaning and the tertiary cleaning, contact-type cleaning (e.g., cleaning with a PVA sponge in the form of a pencil or a roll) and non-contact-type cleaning (e.g., cleaning with a cavitation jet or a liquid to which supersonic wave is applied) may be combined as needed.

A polishing end point in the polishing unit 240 may be managed by polishing time. Alternatively, light (laser, LED, or the like) having a predetermined shape and intensity may be applied in a normal direction of the device-formed surface of the wafer to a portion of the bevel portion at which the polishing head is not located, by an optical means, which is not shown, and irregularities of the bevel portion may be measured by measurement of scattered light to detect a polishing end point based on the measurement of the irregularities.

In the above embodiments, the wafer is rotated by the rollers 1 or 11. However, the wafer 100 may be rotated while the reverse face of the wafer 100 is attracted by a vacuum chuck. Further, in the above embodiments, there has been described an example in which a gas is ejected onto the device-formed surface of the wafer 100 in order to remove polishing wastes. However, a liquid such as pure water may be flowed onto the device-formed surface.

Figure 17:
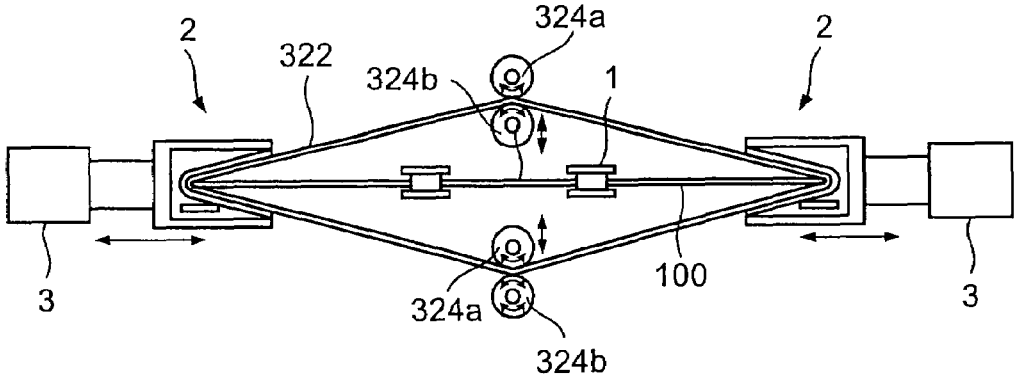
FIG. 17 is a front cross-sectional view showing a modification of the polishing unit shown in FIG. 4.

Further, a polishing unit shown in FIG. 17 may be used instead of the polishing unit shown in FIG. 4. This polishing unit holds an endless polishing tape 322 by pairs of elastic rollers 324*a*, 324*b*, which are disposed above and below the wafer, and rotates the elastic rollers 324*a*, 324*b* to feed the endless polishing tape 322.

Figure 18:
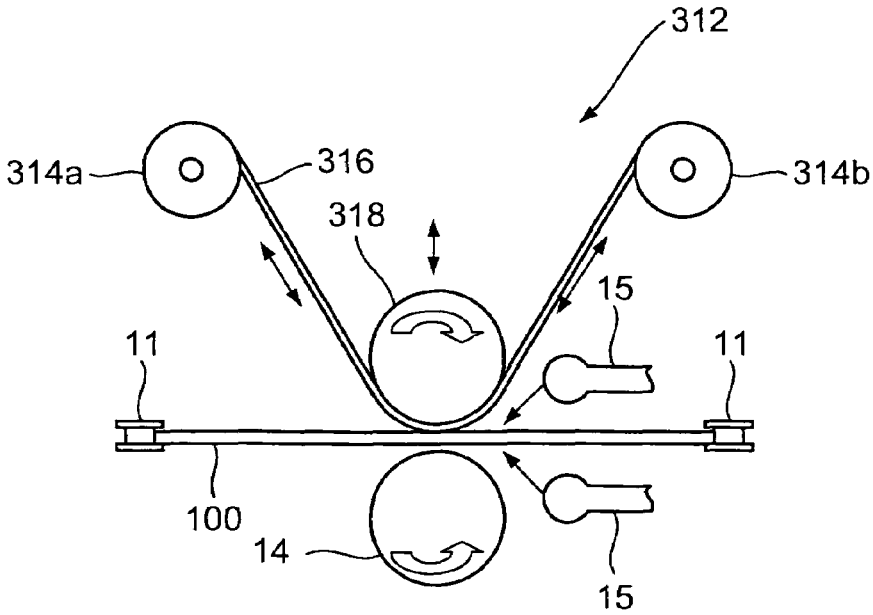
FIG. 18 is a front cross-sectional view showing a modification of the second polishing unit shown in FIG. 13.

Further, a polishing unit shown in FIG. 18 may be used instead of the second polishing unit shown in FIG. 13. The polishing head 312 of the polishing unit comprises a polishing tape 316 which can be taken up by reels 314*a*, 314*b*, and a roll 318 for pressing the polishing tape 316 against the reverse face of the wafer 100. The polishing film 316 is reciprocated or continuously moved at a predetermined speed by the reels 314*a*, 314*b* to polish the reverse face of the wafer 100.

Figure 19:
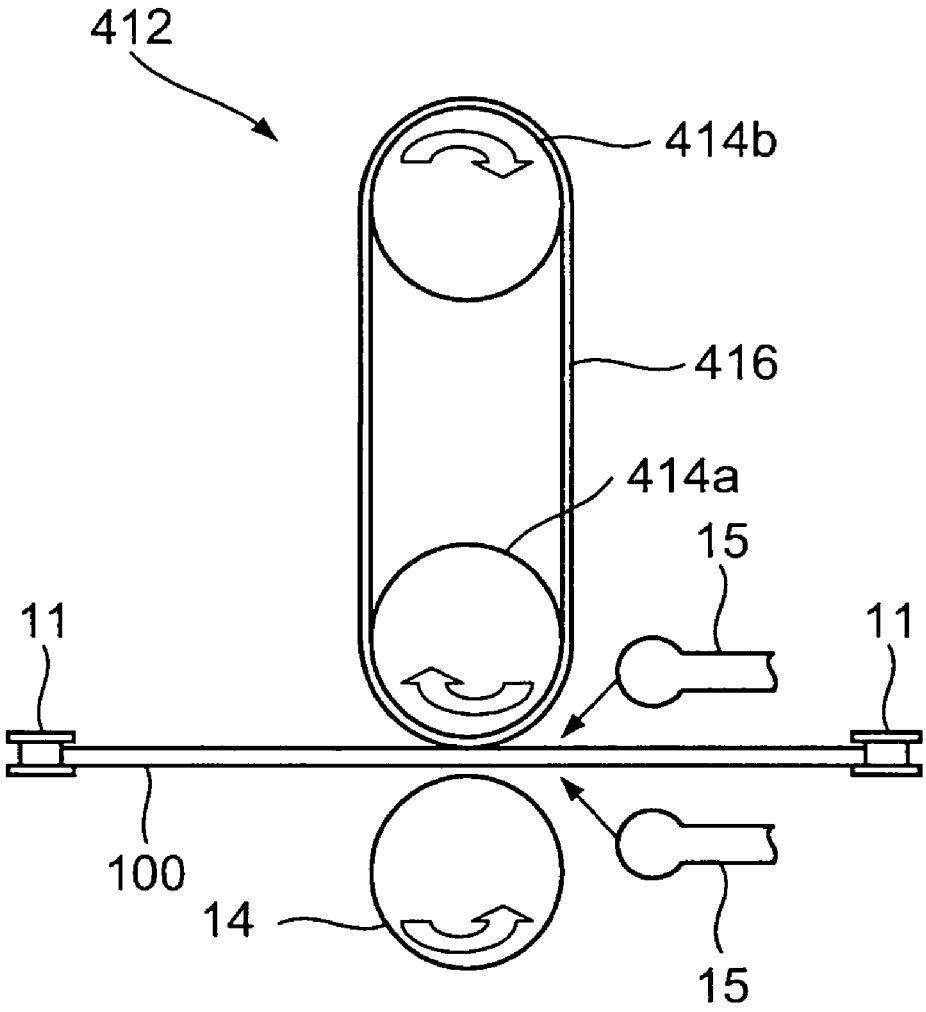
FIG. 19 is a front cross-sectional view showing a modification of the second polishing unit shown in FIG. 13.

Further, a polishing unit shown in FIG. 19 may be used instead of the second polishing unit shown in FIG. 13. The polishing head 412 of the polishing unit comprises a polishing tape 416 wound between rollers 414*a* and 414*b* and rotates the rollers 414*a*, 414*b* to feed the polishing tape 416. At that time, the polishing tape 416 is pressed against the reverse face of the wafer 100 by the lower roller 414*a*.

Furthermore, in the above embodiments, there has been described an example in which an air cylinder is used as a pressing mechanism. However, not only an air cylinder, but also various other pressing mechanisms may be used. Further, in the above embodiments, there has been described an example in which the pressing mechanism presses the polishing head 2 and the elastic member 21 so that a pressing force applied to the polishing film 22 during polishing is kept constant. However, the present invention is not limited to this example. A pressing force by the pressing mechanism may be adjusted to vary a pressing force applied to the polishing film 22 during polishing, thereby achieving a desired polishing profile at a surface of the wafer 100 to be polished (the bevel portion and the edge portion, or the reverse face). Further, in order to perform rough polishing through final polishing with only one kind of polishing tape, a pressing force by the pressing mechanism may be adjusted during polishing so that a pressing force is gradually or continuously reduced from the rough polishing process to the final polishing process.

Further, various conditions during polishing can be changed as needed. The form of the polishing film and the abrasive particles on the polishing film are not limited to the above examples. For example, materials having mechanochemical effects to silicon, such as $BaCO_3$ or $CaCO_3$, can be used as abrasive particles.

Further, in the above embodiments, there has been described an example in which a Si wafer is used as a substrate. However, a SOI wafer, other semiconductor wafers such as a SiGe wafer, a Si wafer having a device-formed surface formed of SiGe, or the like may be used. Furthermore, only the bevel portion, or only the reverse face of the substrate may be polished.

As described above, by removing needle projections at a bevel portion and an edge portion of a substrate by polishing with use of a polishing film, it becomes unnecessary to protect a device-formed surface with a resist, which has been essential in the conventional CDE method. As a result, it is possible to omit two processes including applying a resist for protection and removing the resist after removing needle projections, thereby resulting in an improved throughput. Further, since a surface on the bevel portion and the edge portion from which the needle projections have been removed becomes a smooth surface, the aforementioned problems in the CDE method can be solved.

Further, by removing a film attached to a peripheral portion of a substrate or the like, which would cause contamination, by polishing with use of a polishing tape, the removal process can be achieved with a single process. Therefore, a film which would cause contamination can be removed in a shorter time as compared to the conventional wet-etching method, and hence the throughput can be improved.

Further, since a thin polishing film is used as a polishing tape, the polishing tape is not folded or bent on a surface of a substrate, particularly at a peripheral portion (a bevel portion and an edge portion). Therefore, the polishing tape can be reliably fitted along a curved shape of the peripheral portion of the substrate, and hence it is possible to uniformly polish the peripheral portion of the substrate. As a result, needle projections formed on a surface of a substrate or an undesired Ru film attached to a surface of a substrate can be removed uniformly and stably by polishing. Further, the processing time can be reduced to improve the throughput.

Further, since the polishing head is pressed by the pressing mechanism so that a pressing force applied to the polishing tape during polishing is maintained at a predetermined pressing force, a tension of the elastic body hardly changes irrespective of the deterioration of the elastic body, and hence a polishing rate by the polishing tape can continuously be kept constant to achieve uniform polishing.

Furthermore, by supplying a pressurized fluid to the fluid bag, the fluid bag supporting the polishing tape is deformed so that the polishing tape is brought into contact uniformly with the surface of the substrate. Therefore, it is possible to uniformly polish the surface of the substrate.

While some embodiments of the present invention have been described above, the present invention is not limited to the aforementioned embodiments. It should be understood that various changes and modifications may be made therein without departing from the scope of the technical concept.

What is claimed is:

1. A substrate processing apparatus comprising:

a polishing tape;

a rotation mechanism for rotating a substrate;

a polishing head for pressing said polishing tape against a bevel portion of the substrate rotated by said rotation mechanism, said polishing head comprising:

a support member having two support portions forming a recess; and an elastic member, attached to ends of said two support portions and extending between said ends of said two support portions, for supporting said polishing tape;

a moving mechanism for moving said polishing head in a radial direction of the substrate, said moving mechanism comprising a pressing mechanism for pressing said polishing head against the substrate; and a pressing plate for pressing said elastic member and said polishing tape against an edge portion of the substrate, said pressing plate being disposed between said support portions wherein said polishing head is moved in said radial direction of the substrate by said moving mechanism to allow said elastic member, said polishing tape and the bevel portion of the substrate to enter said recess of said support member, and to elongate said elastic member to thus produce a tension in said elastic member for pressing said polishing tape against the bevel portion of the substrate so that a constant force is applied to said polishing tape during polishing; and wherein the bevel portion of the substrate is polished by sliding contact between said polishing tape and the substrate rotated by said rotation mechanism.

2. A substrate processing apparatus as defined in claim 1, wherein said pressing plate is movable in said radial direction of the substrate.

3. A substrate processing apparatus as defined in claim 1, further comprising a grinding wheel for polishing a notch of said substrate.

4. A substrate processing apparatus as defined in claim 3, further comprising a notch sensor for detecting said notch of said substrate.

5. A substrate processing apparatus as defined in claim 1, further comprising at least one liquid supply nozzle for supplying a chemical liquid or pure water to the bevel portion of the substrate.

6. A substrate processing apparatus as defined in claim 1, further comprising an optical device for detecting a polishing end point.

7. A substrate processing apparatus as defined in claim 1, further comprising a device configured to supply one of a gas and pure water to a device-formed surface of the substrate to prevent polishing wastes produced during polishing from contaminating the device-formed surface.

8. A substrate processing apparatus as defined in claim 1, further comprising at least one nozzle to perform a primary cleaning after polishing the bevel portion of the substrate.

9. A substrate processing apparatus as defined in claim 1, wherein said pressing mechanism comprises an air cylinder.

* * * * *